US008000976B2

(12) United States Patent
Tashiro et al.

(10) Patent No.: US 8,000,976 B2
(45) Date of Patent: Aug. 16, 2011

(54) SPEECH BAND EXTENSION DEVICE

(75) Inventors: Atsushi Tashiro, Kanagawa (JP); Hiromi Aoyagi, Kanagawa (JP)

(73) Assignee: OKI Electric Industry Co., Ltd., Tokyo (JP)

( * ) Notice: Subject to any disclaimer, the term of this patent is extended or adjusted under 35 U.S.C. 154(b) by 1029 days.

(21) Appl. No.: 11/884,780

(22) PCT Filed: Jan. 27, 2006

(86) PCT No.: PCT/JP2006/301287

§ 371 (c)(1),
(2), (4) Date: Aug. 21, 2007

(87) PCT Pub. No.: WO2006/090553

PCT Pub. Date: Aug. 31, 2006

(65) Prior Publication Data

US 2008/0255831 A1 Oct. 16, 2008

(30) Foreign Application Priority Data

Feb. 22, 2005 (JP) ..... 2005-045995

(51) Int. Cl.
*G10L 21/04* (2006.01)

(52) U.S. Cl. ..... 704/503; 704/211; 704/500; 704/501; 704/502; 704/504

(58) Field of Classification Search ..... None
See application file for complete search history.

(56) References Cited

U.S. PATENT DOCUMENTS

| | | | | |
|---|---|---|---|---|
| 6,233,550 | B1 * | 5/2001 | Gersho et al. | 704/208 |
| 6,449,519 | B1 | 9/2002 | Kuwaoka | |
| 7,003,121 | B1 * | 2/2006 | Arknæs-Pedersen | 381/67 |
| 2002/0188365 | A1 * | 12/2002 | Kuwaoda | 700/94 |
| 2004/0122662 | A1 * | 6/2004 | Crockett | 704/200.1 |
| 2005/0195990 | A1 * | 9/2005 | Kondo et al. | 381/92 |

FOREIGN PATENT DOCUMENTS

| | | | |
|---|---|---|---|
| JP | 7-074564 | A | 3/1995 |
| JP | 09-146593 | | 6/1997 |
| JP | 09-258787 | | 10/1997 |
| JP | 11-126097 | | 5/1999 |
| JP | 2004-350077 | A | 12/2004 |

* cited by examiner

*Primary Examiner* — Leonard Saint Cyr
(74) *Attorney, Agent, or Firm* — Rabin & Berdo, PC

(57) ABSTRACT

A speech band extension device (100), which generates an audio signal capable of realizing natural audibility after speech band extension, includes a band-extended audio generator which generates a band-extended audio signal from an original audio signal, the band-extended audio signal including components lying within a frequency band that is not included in a frequency band of the original audio signal, and an adjustment adder (20) which detects a timing shift between the original audio signal and the band-extended audio signal, adjusts timing of the original audio signal and timing of the band-extended audio signal in accordance with the detected timing shift, and combines the both signals after the adjusting of the timing, wherein the detection of the timing shift is performed, for example, using zero-crossing and cross-correlation.

7 Claims, 5 Drawing Sheets

SPEECH BAND EXTENSION DEVICE

TECHNICAL FIELD

The present invention relates to a speech band extension device, and, for example, can be applied to a device for broadening a frequency band of an audio signal supplied from a narrow band telephone set or a narrow band telephone exchange system.

BACKGROUND ART

At the present time, voice communication such as telephone speech communication is popular through the use of various networks. Nevertheless, frequencies of telephone speech communication are typically limited to frequencies from 300 Hz to 3.4 kHz, generally called "telephone band", according to customs in the days of conventional public networks. However, the human voice contains low-band components of 300 Hz or lower and high-band components of 3.4 kHz or higher. These low-band components and high-band components are important components which may influence voice personality. Moreover, for the elderly people, lack of these low-band components and high-band components not only causes lack of voice personality but also makes speech understanding difficult. Thus, it is desired that the telephone speech communication covers these components.

However, a telephone exchange system in a general public network cannot transmit an audio signal outside the telephone band. In view of this point, Patent Document 1 proposes a band extension device for extending an audio frequency band.

The method of the band extension device described in Patent Document 1 will be described with reference to FIG. 2. A narrow-band audio signal (digital signal) DC whose frequency is limited to a range from 300 Hz to 3.4 kHz is inputted to the band extension device 10. The narrow-band audio signal DC is converted to a converted original signal S whose sampling frequency (e.g., from 8 kHz to 16 kHz) is raised by the sampling frequency converter 11. Through the use of the converted original signal S, an extended signal (a low-band signal for combination) LS extended to a lower band side (300 Hz or lower), an extended signal (a high-band signal for combination) HS extended to a higher band side (3.4 kHz to 7 kHz), and an extended signal (a soundless-section signal for combination) US obtained by extending a soundless section are generated by a low-band signal generator 12, a high-band signal generator 13, and a soundless-section signal generator 14, respectively. These signals are added to the above-mentioned converted original signal S by the adder 15 to generate a band-extended signal V.

The band-extended signal V provides a transmitted signal concurrently with a low-band component signal, a high-band component signal or the like, which are generated from a band-limited narrow-band audio signal DC. Therefore, one can hear a sound with more realism that is similar to a sound generated from a wide-band signal containing these low-band and high-band component signals.

Patent Document 1 is Japanese Patent Application Kokai (Laid Open) Publication No. 9-258787.

DISCLOSURE OF THE INVENTION

Problem to be Solved by the Invention

However, in the frequency band extension method of Patent Document 1, frequency components of the newly generated component signal is different from those of the original signal, and the newly generated component signal and the transmitted original signal are simply added and combined regardless of phase relationship between the both signals. For this reason, a finally-produced wide-band audio signal may be an audio signal that may cause unnatural audibility (unnatural feeling of hearing) in comparison with an inherent wide-band audio signal.

Therefore, it is desired to provide a speech band extension device that is able to generate an audio signal capable of realizing natural audibility after frequency band extension.

Means for Solving the Problem

To resolve the above-mentioned problem, a speech band extension device of the present invention includes: band-extended audio generation means which generates a band-extended audio signal from an original audio signal, the band-extended audio signal including components lying within a frequency band that is not included in a frequency band of the original audio signal; timing shift detection means which detects a timing shift between the original audio signal and the band-extended audio signal; adjustment means which adjusts at least one of timing of the original audio signal and timing of the band-extended audio signal in accordance with the detected timing shift; and combination means which combines the original audio signal and the band-extended audio signal after the adjusting of the timing.

Effect of the Invention

According to the speech band extension device of the present invention, since an original audio signal and a band-extended audio signal which have different frequency bands are combined after timing synchronization, the device is able to generate an audio signal capable of realizing natural audibility after frequency band extension.

DESCRIPTION OF THE REFERENCE NUMERALS OR SYMBOLS

11 sampling frequency converter; 12 low-band signal generator; 13 high-band signal generator; 14 soundless-section signal generator; 20 adjustment adder; 21 low-band adjustment adder; 22 high-band adjustment adder; 23 soundless-section adjustment adder; 31, 32 zero-crossing detector; 33, 133 delay detector; 34, 42, 134, 135 adjuster; 35 addition circuit; 41 correlation calculator; 54 period detector; 51 low-band adjuster; 52 high-band adjuster; 53 soundless-section adjuster; 54 combination adder; 100 speech band extension device.

BEST MODE FOR CARRYING OUT THE INVENTION

(A) First Embodiment

A speech band extension device according to the first embodiment of the present invention will be described below with reference to the drawings.

Figure 1:
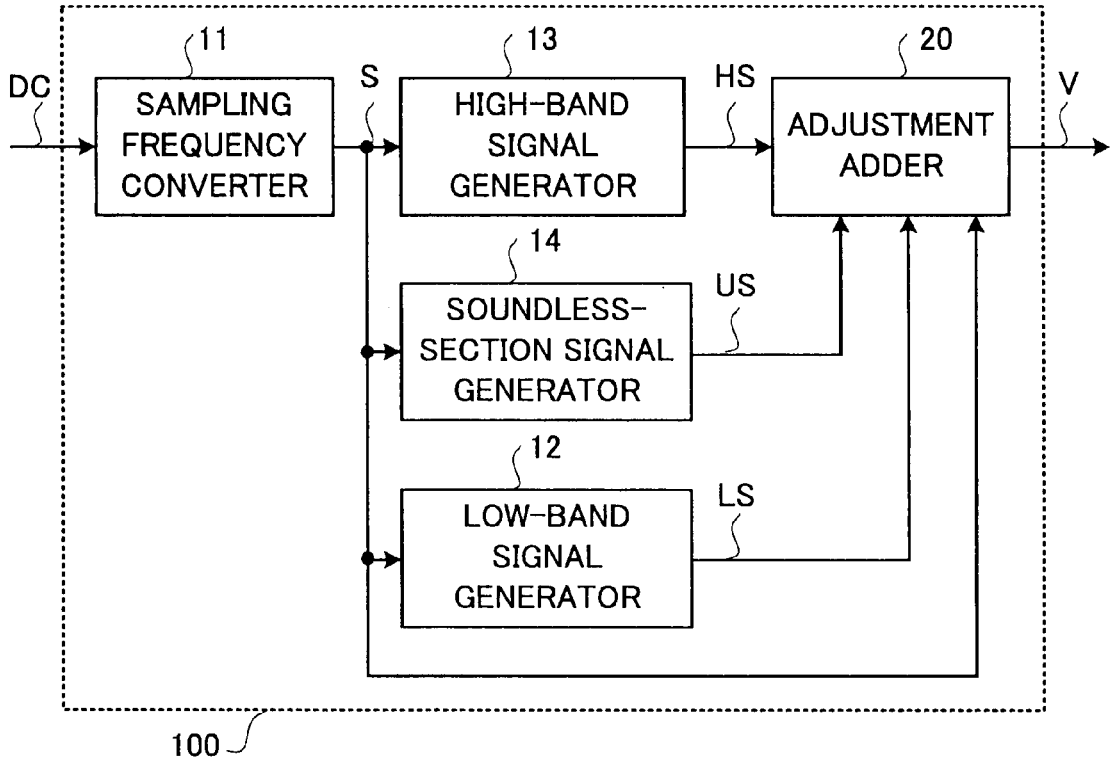
FIG. 1 is a block diagram showing a configuration of a speech band extension device according to the first embodiment.
Figure 2:
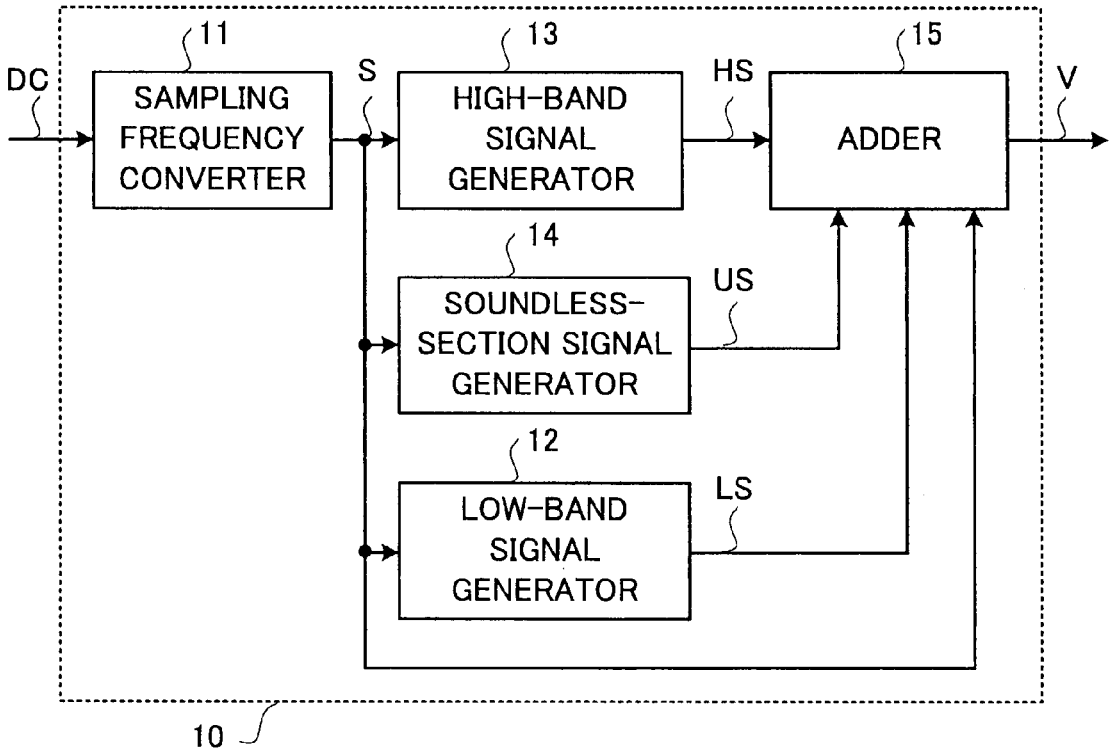
FIG. 2 is a block diagram showing a configuration of a conventional frequency band extension device.

FIG. 1 is a block diagram showing a configuration of a speech band extension device 100 of the first embodiment. Constituent elements in FIG. 1 that are the same as or correspond to those in FIG. 2 showing the above-described conventional art are assigned the same reference numerals or symbols.

Referring to FIG. 1, the speech band extension device 100 of the first embodiment includes a sampling frequency converter 11, a low-band signal generator 12, a high-band signal generator 13, a soundless-section signal generator 14, and an adjustment adder 20.

The sampling frequency converter 11, the low-band signal generator 12, the high-band signal generator 13, and the soundless-section signal generator 14 are similar to or substantially the same as those described in Patent Document 1. However, a method for generating a low-band signal for combination LS, a high-band signal for combination HS, and a soundless-section signal for combination US that are provided in order to produce a band-extended signal V is not limited to that described in Patent Document 1 and other existing methods may be available.

In the first embodiment, it is assumed that processing is carried out for each audio frame (frame) of a predetermined period of time (e.g., 10 ms) as a unit and a time length of the frame is not limited. Further, the present invention is not limited to the processing carried out in a fixed-length frame, and can be applied to the processing carried out in a variable-length frame.

The adjustment adder 20, which is provided in place of the adder 15 in FIG. 2, adjusts timing of the low-band signal for combination LS, timing of the high-band signal for combination HS, and timing of the soundless-section signal for combination US relative to a frequency-converted original signal S, and adds these timing-adjusted signals. The adjustment adder 20 differs from the adder 15 in that the adjustment adder 20 adjusts the timing of the signals.

Figure 3:
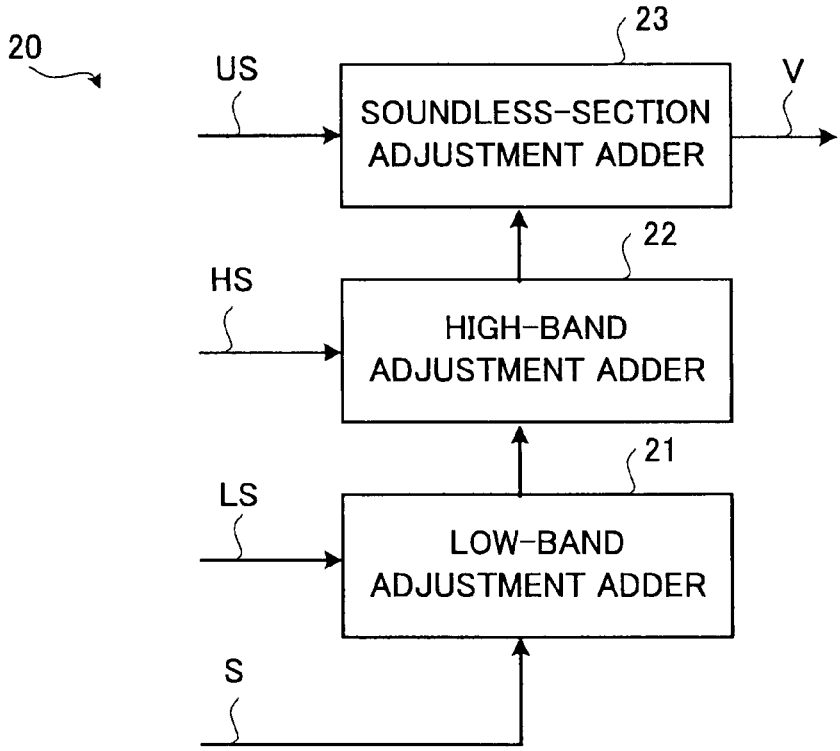
FIG. 3 is a block diagram showing a detailed configuration of an adjustment adder in the first embodiment.

FIG. 3 is a block diagram showing a detailed configuration of the adjustment adder 20 in the first embodiment. Referring to FIG. 3, the adjustment adder 20 in the first embodiment includes a low-band adjustment adder 21, a high-band adjustment adder 22, and a soundless-section adjustment adder 23.

The low-band adjustment adder 21 synchronizes timing of the frequency-converted original signal S and the low-band signal for combination LS outputted from the low-band signal generator 12, and adds the frequency-converted original signal S and the low-band signal for combination LS after the timing synchronization. The high-band adjustment adder 22 synchronizes timing of an output signal from the low-band adjustment adder 21 (a low-band-extended signal LV) and the high-band signal for combination HS outputted from the high-band signal generator 13, and adds the output signal from the low-band adjustment adder 21 and the high-band signal for combination HS after the timing synchronization. The soundless-section adjustment adder 23 synchronizes timing of an output signal from the high-band adjustment adder 22 (a high-band-extended signal HV) and the soundless-section signal for combination US outputted from the soundless-section signal generator 14, and adds the output signal from the high-band adjustment adder 22 and the soundless-section signal for combination US after the timing synchronization.

FIG. 3 shows that a case where the low-band adjustment adder 21, the high-band adjustment adder 22, and the soundless-section adjustment adder 23 are in cascade connection in the above-mentioned order. However, the order of the cascade-connection of these three adjustment adders is not limited to that shown in FIG. 3 and may be voluntarily selected.

Figure 4:
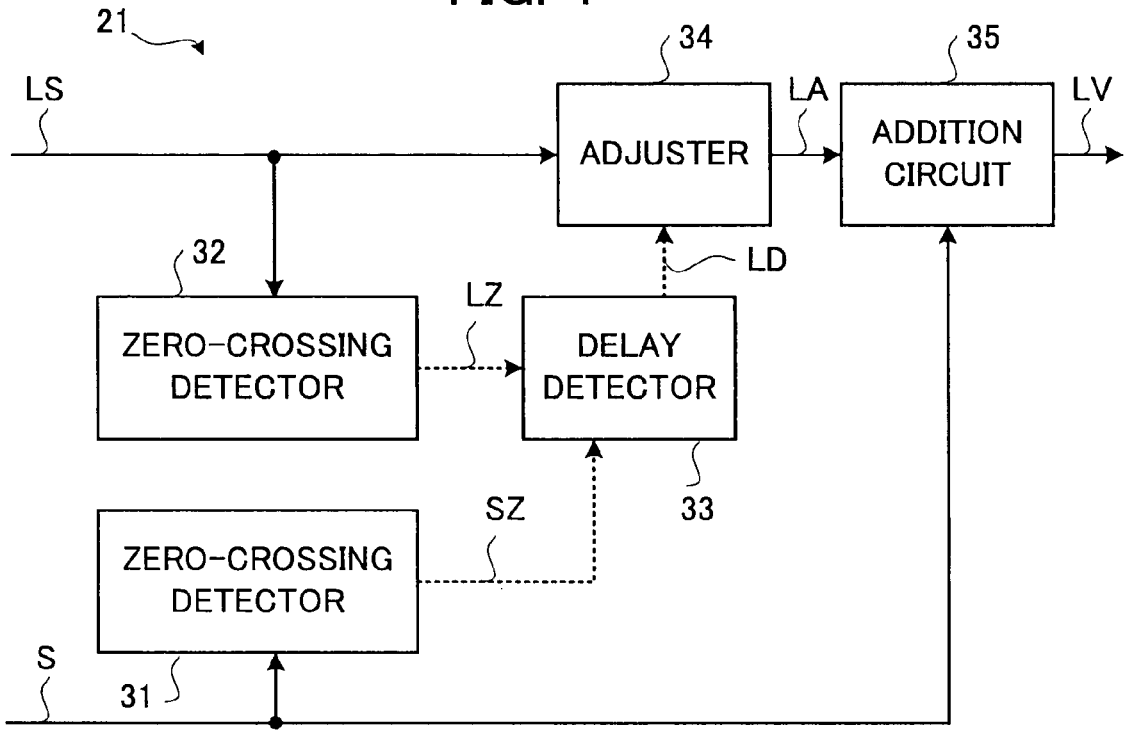
FIG. 4 is a block diagram showing a detailed configuration of a low-band adjustment adder in the first embodiment.

The low-band adjustment adder 21, the high-band adjustment adder 22, and the soundless-section adjustment adder 23 have similar configuration. FIG. 4 is a block diagram showing a detailed configuration of the low-band adjustment adder 21, whereas the high-band adjustment adder 22 and the soundless-section adjustment adder 23 have similar detailed configurations.

The low-band adjustment adder 21 includes two zero-crossing detectors 31 and 32, a delay detector 33, an adjuster 34, and an addition circuit 35.

The first zero-crossing detector 31 detects a zero-crossing (zero-cross) timing of the frequency-converted original signal S to output original zero-cross information SZ to the delay detector 33. The zero-crossing detector 31 for detecting a zero-crossing of the frequency-converted original signal S may be shared with the other adders such as the high-band adjustment adder 22 and the soundless-section adjustment adder 23.

The second zero-crossing detector 32 detects a zero-crossing (zero-cross) timing in the low-band signal for combination LS to output low-band zero-crossing information LZ to the delay detector 23.

The delay detector 33 outputs to the adjuster 34 delay information LD of the low-band signal for combination LS based on the original zero-crossing information SZ and the low-band zero-crossing information LZ. The low-band signal for combination LS is shifted in phase from the frequency-converted original signal S due to processing at the low-band signal generator 12 and the like.

The adjuster 34 produces an adjusted low-band signal LA which is delayed from the low-band signal for combination LS by an amount of the delay based on the delay information LD, and outputs it to the addition circuit 35.

The addition circuit 35 adds the frequency-converted original signal S and the adjusted low-band signal LA to output a low-band-extended signal LV which has a low-band section extended in comparison with the frequency-converted original signal S.

Each of the high-band adjustment adder 22 and the soundless-section adjustment adder 23 has a detailed configuration similar to that of the low-band adjustment adder 21. The high-band adjustment adder 22 receives the signal LV and a signal HS in place of two types of input signals S and LS inputted to the low-band adjustment adder 21, and outputs the high-band-extended signal HV. The soundless-section adjustment adder 23 receives the signal HV and a signal US in place of two types of input signals S and LS inputted to the low-band adjustment adder 21, and outputs a soundless-section-extended signal UV, which is the band-extended signal V.

Operations of the low-band adjustment adder 21 will be described below in detail. In the low-band adjustment adder 21, the elements operate as described below every audio frame input.

The first zero-crossing detector 31 calculates a zero-crossing time of the input frequency-converted original signal S and a gradient at the zero-crossing time, and supplies the zero-crossing information SZ containing the zero-crossing time and the gradient to the delay detector 33. For the zero-crossing detection, a zero-crossing time is defined as a time at which a product of a sample value at the current time and a sample value at the immediately preceding time becomes negative, for example. Further, the gradient is determined as positive if a sample value at the zero-crossing time is positive and is determined as negative if a sample value at the zero-crossing time is negative. However, the zero-crossing detection and the gradient determination are not limited to these methods. In order to improve accuracy of the zero-crossing time detection, it is possible that a well-known DC-component canceling method or a noise canceling method is applied to a signal inputted to the zero-crossing detector 21 (here, the frequency-converted original signal S) to generate a signal to be determined before the determination and a zero-crossing detection is performed for the generated signal to be determined.

Operation of the second zero-crossing detector 32 is substantially the same as operation of the first zero-crossing detector 31 except that the second zero-crossing detector 32 receives the low-band signal for combination LS in place of the frequency-converted original signal S and the second zero-crossing detector 32 outputs the low-band zero-crossing information LZ in place of the original zero-crossing information SZ. Therefore, operation of the second zero-crossing detector is not described here.

The delay detector 33 receives the zero-crossing information SZ determined from the frequency-converted original signal S and the low-band zero-crossing information LZ determined from the low-band signal for combination LS, calculates a delay time of the low-band signal for combination LS relative to the frequency-converted original signal S, and outputs the delay time as delay information LD to the adjuster 34. The delay time is, for example, defined as a time difference between the zero-crossing times, each having a positive gradient first detected in a frame, of the original zero-crossing information SZ and the low-band zero-crossing information LZ. However, determination of the delay time is not limited to this method. A delay time may be a time difference between a zero-crossing time determined from the original zero-crossing information SZ and another zero-crossing time determined from the low-band zero-crossing information LZ in a frame, the another zero-crossing time being the nearest to the zero-crossing time determined from the original zero-crossing information SZ. However, it is necessary that a reference time of the delay time is a zero-crossing time of the original zero-crossing information SZ. In the first embodiment, an allowable delay-time range is set between −3 ms and 3 ms, and if a delay time out of this range occurs, the delay time is treated as 0 ms. This rule can be arbitrarily set in accordance with performance required by a designer. A delay time of 0 ms means that there is no delay.

The adjuster 34 receives the low-band delay information LD from the delay detector 33, extracts the delay time from the low-band delay information, delays the low-band signal for combination LS by a delay amount of the delay time, adjusts time points of zero-crossing of the two signals so as to be the same, and outputs the adjusted signal as an adjustment signal LA to the addition circuit 35.

An excess or short supply of the signal in a frame due to the delay-time addition is adjusted as follows, for example.

Figure 5:
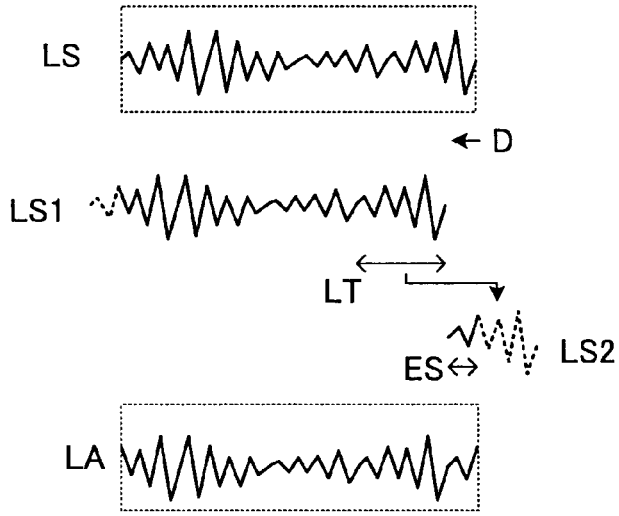
FIG. 5 is an explanatory diagram showing processing at an adjuster in the low-band adjustment adder in the first embodiment.

A case in which the delay-time addition causes an advance of the adjustment signal LA relative to the low-band signal for combination LS will be described with reference to FIG. 5. FIG. 5 shows the low-band signal for combination LS in a frame before delay addition, a delayed signal LS1 which is obtained by delaying the signal LS by a delay amount D, an interpolation signal LS2 compensating for a shortage of the signal as described below and the adjusted low-band signal LA after adjustment.

In this case, the delay amount D adds a negative delay. Due to the delay-time addition, a shortage of the signal is caused in the latest portion of an audio frame. Accordingly, a waveform period LT at the latest edge of the delayed signal LS1 is firstly calculated. The period LT may be calculated through the use of a well-known autocorrelation function, for example, but the period calculation method is not limited to this method. With reference to the period LT, a signal waveform of one period from the latest edge to the oldest portion of the delayed signal LS1 is replicated as the interpolation signal LS2 at a position shifted just one period LT toward the latest portion, a portion ES in the interpolation signal LS2, corresponding to the shortage of the signal waveform, is combined with the delayed signal LS1 and the adjusted low-band signal LA is generated.

In the first embodiment, the period LT ranges from 3 ms to 6 ms. Since a delay amount is 3 ms at most, holding the oldest one period enables compensating for the shortage. If the delay amount is larger than the period LT, it is possible to hold two periods of a signal for compensating for the shortage. Thus, how to determine the interpolation signal LS2 is not limited and a designer may arbitrarily decide the manner.

When the interpolation signal LS2 is obtained, it is also available that a result obtained by weighting each of a portion beyond one period and the delayed signal LS1 and superimposing them is used as the adjusted low-band signal LA through the use of a signal of a time period over one period LT (e.g., a time period of the latest 4 ms). It is preferable to set a weight ratio for the superimposing to be 100% in total and to set the weight so that the delayed signal LS1 continuously shifts to the interpolation signal LS2 with the lapse of time.

Moreover, a signal required for calculating the period LT may be held longer than a signal shown in the figure. Likewise, a signal in the oldest portion of a frame may be overlapped and weighted with it in the immediately preceding frame.

When the delay-time addition causes a delay of the adjustment signal LA from the low-band signal for combination LS (i.e., when a positive delay is added), that is, when signal shortage occurs in the oldest portion of a frame, adjustment can be performed as in the case where the adjustment signal LA advances the low-band signal for combination LS. It is also available to hold a past signal in a predetermined period of time (3 ms or more in the first embodiment), to compensate for the shortage by the held immediately-preceding signal and to perform superimposing and weighting.

The addition circuit 35 adds the frequency-converted original signal S and the adjusted low-band signal LA to generate the low-band-extended signal LV. Here, the frequency-converted original signal S and the adjusted low-band signal LA are weighted and added. An addition ratio for each of the components indicated in the speech band extension method of the first embodiment may be used for the weighting.

Although the input signals and output signals are different, the high-band adjustment adder 22 and the soundless-section adjustment adder 23 operate in the similar manner to the low-band adjustment adder 21.

According to the above-described first embodiment, synchronizing zero-crossing positions enables to synchronize a phase of a band-extended component signal with an original signal and enables to suppress a noise caused when the signals are added due to a phase shift in the band-extended component signal. Accordingly, the quality of an output audio signal (band-extended signal) can be improved.

(B) Second Embodiment

A speech band extension device according to the second embodiment of the present invention will be described below with reference to the drawings.

The speech band extension device of the second embodiment includes, in a similar manner to that of the first embodiment, a sampling frequency converter 11, a low-band signal generator 12, a high-band signal generator 13, a soundless-section signal generator 14, and an adjustment adder 20 (see FIG. 1). Further, the adjustment adder 20 includes a low-band adjustment adder 21, a high-band adjustment adder 22, and a soundless-section adjustment adder 23 (see FIG. 3).

The second embodiment differs from the first embodiment in detailed configurations of the low-band adjustment adder 21, the high-band adjustment adder 22, and the soundless-section adjustment adder 23.

Figure 6:
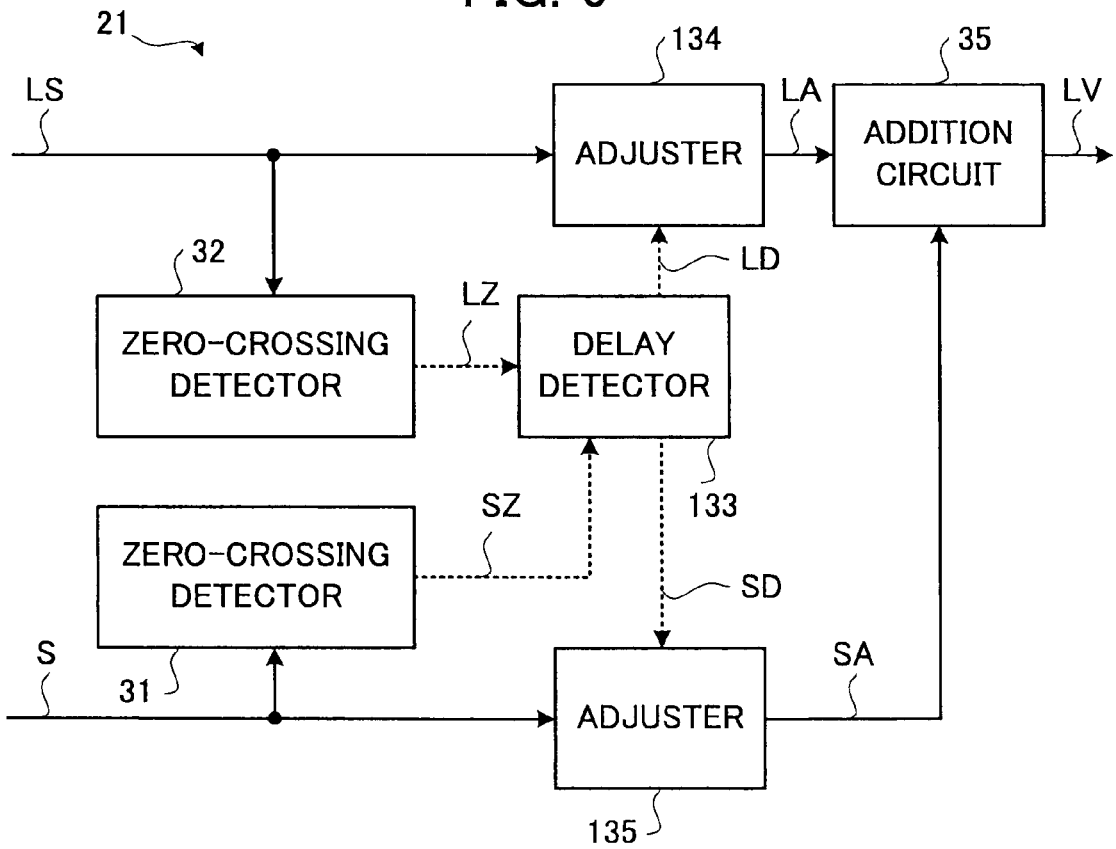
FIG. 6 is a block diagram showing a detailed configuration of a low-band adjustment adder in the second embodiment.

FIG. 6 is a block diagram showing a detailed configuration of the low-band adjustment adder 21 in the second embodiment. Constituent elements in FIG. 6 that are the same as or correspond to those in FIG. 4 showing the above-described fourth embodiment are assigned the same reference numerals or symbols.

In the second embodiment, a delay detector 133, which receives zero-crossing information SZ from a first zero-crossing detector 31 and receives low-band zero-crossing information LZ from a second zero-crossing detector 32, outputs original delay information SD as well as low-band delay information LD, in contrast to a delay detector 33 in the first embodiment.

An adjuster 134 in the second embodiment, in a similar manner to that in the first embodiment, receives a low-band signal for combination LS and the low-band delay information LD, delays the low-band signal for combination LS in accordance with the low-band delay information LD, and then outputs an adjusted low-band signal LA. However, the adjuster 134 in the second embodiment is different from the adjuster 34 in the first embodiment in the respects that the adjuster 134 can delay low-band signal for combination LS only in a positive direction.

The adjuster 135 which is newly provided in the second embodiment has substantially the same configuration as that of the adjuster 134. The adjuster 135 receives the frequency-converted original signal S and the original delay information SD and outputs an original adjustment signal SA that is obtained by delaying the frequency-converted original signal S in accordance with the original delay information SD.

Further, in the second embodiment, each of the high-band adjustment adder 22 and the soundless-section adjustment adder 23 has a similar or substantially the same detailed configuration as that of the low-band adjustment adder 21.

Operations of the delay detector 133, the adjuster 134, and the addition circuit 135 characterizing the second embodiment will be described below.

The delay detector 133, in a similar manner to the delay detector 33 in the first embodiment, calculates a delay time with reference to the original zero-crossing information SZ, through the use of the input original zero-crossing information SZ and the low-band zero-crossing information LZ. The delay detector 133 differs from the delay detector 33 in the first embodiment in the following point: if the calculated delay time is a positive delay time, the delay detector 133 inserts the delay time in the low-band delay information LD and inserts a zero delay time in the original delay information SD, on the other hand, if the calculated delay time is a negative delay time, the delay detector 133 inserts a zero delay time in the low-band delay information LD and inserts the sign-inversed delay-time in the original delay information SD.

The adjuster 134, in a similar manner to the adjuster 34 in the first embodiment, delays the low-band signal for combination LS by an amount of the inserted delay time in the received low-band delay information LD. The adjuster 134 differs from the adjuster 34 in the first embodiment in the point that only a positive delay is reflected in signal adjustment processing. Although, in the first embodiment, it is required that a signal is adjusted in both of the positive and negative directions because the delay time inserted in the low-band delay information takes on either of positive and negative values, it is enough to consider only a delay in the positive direction and accordingly complexity in processing can be reduced as a delay in the negative direction is not addressed, in the second embodiment.

The adjuster 135 using the frequency-converted original signal S in place of the low-band signal for combination LS and using the original delay information SD in place of the low-band delay signal LD, operates in a similar manner to the adjuster 134 and addresses only a positive delay. Although only a positive delay is addressed in the above description, the adjuster 135 may address only a negative delay.

According to the second embodiment, the following effects can be realized in addition to substantially the same effects as those in the first embodiment.

Providing two adjusters enables to eliminate determination of sign of delay amount, and restricting adjustment functions enables to eliminate complexity of processing. Therefore, processing amount can be reduced and the device can be downsized.

(C) Third Embodiment

A speech band extension device according to the third embodiment of the present invention will be described below in detail with reference to the drawings.

The speech band extension device in the third embodiment includes, in a similar manner to that in the first embodiment, a sampling frequency converter 11, a low-band signal generator 12, a high-band signal generator 13, a soundless-section signal generator 14, and an adjustment adder 20 (see FIG. 1). The adjustment adder 20 has a low-band adjustment adder 21, a high-band adjustment adder 22, and a soundless-section adjustment adder 23 (see FIG. 3).

The third embodiment differs from the first embodiment in a detailed configuration of the low-band adjustment adder 21, the high-band adjustment adder 22, and the soundless-section adjustment adder 23.

Figure 7:
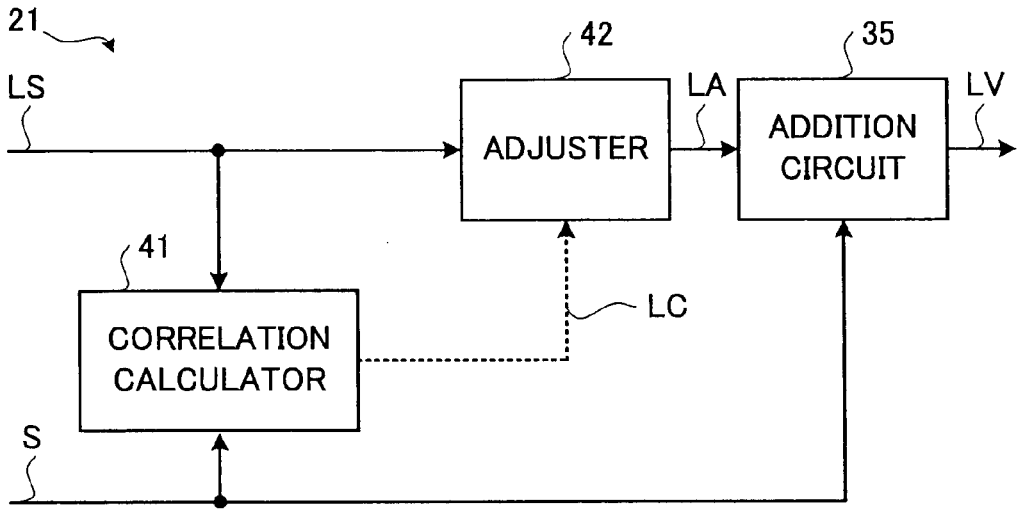
FIG. 7 is a block diagram showing a detailed configuration of a low-band adjustment adder in the third embodiment.

FIG. 7 is a block diagram showing a detailed configuration of the low-band adjustment adder 21 in the third embodiment. Constituent elements in FIG. 7 that are the same as or correspond to those in FIG. 4 showing the above-described the first embodiment are assigned the same reference numerals or symbols.

In the third embodiment, the low-band adjustment adder 21 includes a correlation calculator 41, an adjuster 42, and an addition circuit 35. The high-band adjustment adder 22 and the soundless-section adjustment adder 23 have the configuration similar to that shown in FIG. 7 indicating the low-band adjustment adder 21.

The correlation calculator 41, provided in place of the zero-crossing detectors 31 and 32 and the delay detector 33 in the first embodiment, obtains correlation information (low-band correlation information) LC of a frequency-converted original signal S and a low-band signal for combination LS generated at the low-band signal generator 12 to output to an adjuster 42.

The adjuster 42 in the third embodiment outputs to the addition circuit 35, an adjusted low-band signal LA after the adjusting of the timing according to the low-band correlation information LC and the low-band signal for combination LS.

Functions and operations of the correlation calculator 41 and the adjuster 42 will be described below more particularly.

The correlation calculator 41 calculates a cross-correlation function between the frequency-converted original signal S and the low-band signal for combination LS every frame to determine a delay amount at which the maximum cross-correlation value is obtained, that is, a delay time that the highest correlativity is obtained when the low-band signal for combination LS is delayed. The delay time is provided to the adjuster 42 as the low-band correlation information LC.

If necessary, it may be possible to hold a past conversion original signal S and a past low-band signal for combination LS during a predetermined period of time (e.g., past 10 ms) for calculating a cross-correlation function.

In the above-described calculation of the cross-correlation, only a positive delay is added. However, is also available to determine delay amount at which a maximum cross-correlation value of the low-band signal for combination LS delayed relative to the frequency-converted original signal S at the correlation calculator 41 is obtained, to determine a maximum of the cross-correlation, a maximum of the cross-correlation value of the frequency-converted original signal S relative to the low-band signal for combination LS and delay amount at which the maximum is obtained, to compare the two maximum, and thereby to determine a positive delay or a negative delay from the comparison. That is, if the former maximum of the cross-correlation value with reference to the frequency-converted original signal S is greater than the latter maximum of the cross-correlation value with reference to the low-band signal for combination LS, it is considered as a positive delay; on the other hand, if the maximum of the cross-correlation value with reference to the low-band signal for combination LS is greater than the maximum of the cross-correlation value with reference to the conversion original signal S, it is considered as a negative delay.

Although the third embodiment (FIG. 7) shows, in the similar manner to the first embodiment, an example that a single adjuster adjusts a signal, two adjusters may be provided to adjust a signal in the similar manner to the second embodiment.

The adjuster 42 receives the low-band signal for combination LS and the low-band correlation information LC, delays the low-band signal for combination LS in accordance with the low-band correlation information LC, and outputs the adjusted low-band signal LA. The adjuster 42 adds a delay to the low-band signal for combination LS in a similar manner to the adjuster 24 in the first embodiment.

According to the third embodiment, the same effects of the adjusting of the timing as those in the first embodiment can be obtained and moreover the following effects can be realized.

Providing a correlation calculator enables to determine delay amount as a unique precise value and to improve the accuracy of delay-amount determination and thereby further improvement in quality of an output sound can be expected. Moreover, in comparison with the first and second embodiments, two zero-crossing detectors and a single delay detector can be removed and thereby downsizing of the device configuration can be realized.

(D) Fourth Embodiment

A speech band extension device according to the fourth embodiment of the present invention will be described below in detail with reference to the drawings.

The speech band extension device of the fourth embodiment differs from that in the third embodiment in an internal configuration of a low-band adjustment adder 21, a high-band adjustment adder 22, and a soundless-section adjustment adder 23 in some degree.

Figure 8:
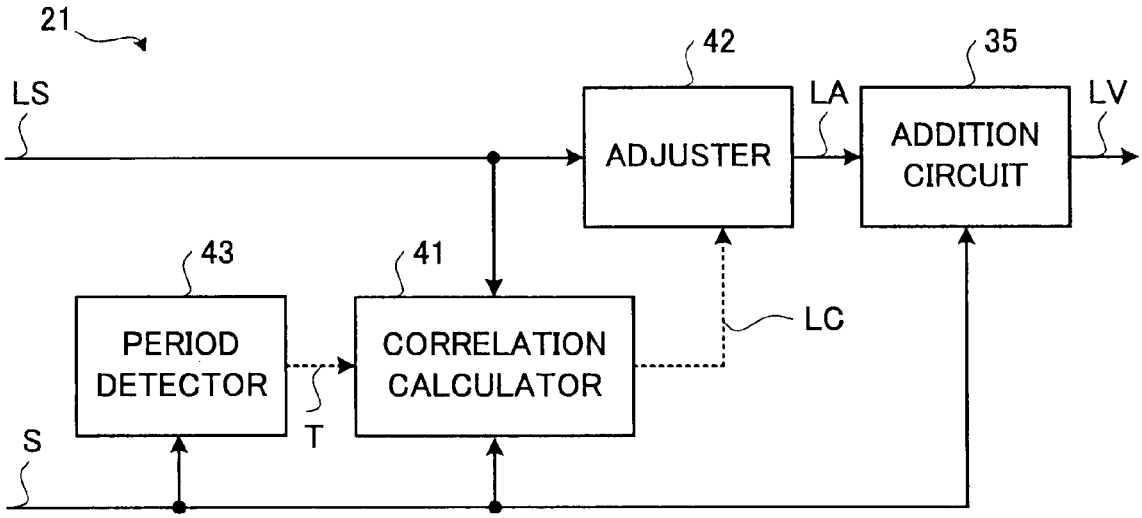
FIG. 8 is a block diagram showing a detailed configuration of a low-band adjustment adder in the fourth embodiment.

FIG. 8 is a block diagram showing a detailed configuration of the low-band adjustment adder 21 in the fourth embodiment. Constituent elements in FIG. 8 that are the same as or correspond to those in FIG. 7 showing the above-described third embodiment art are assigned the same reference numerals or symbols. The high-band adjustment adder 22 and the soundless-section adjustment adder 23 have a configuration similar to that shown in FIG. 8 indicating the low-band adjustment adder 21.

The low-band adjustment adder 21 in the fourth embodiment includes a period detector 43 in addition to the correlation calculator 41, the adjuster 42, and the addition circuit 35. The provision of the period detector 43 causes a slight difference from the third embodiment in a function of the correlation calculator 41.

The period detector 43 receives the frequency-converted original signal S, calculates a wave period of the signal, and outputs the calculated wave-period, as period information T, to the correlation calculator 41. For calculating the wave period, delay amount at which an autocorrelation function is maximized is detected as the wave period of the signal. In order to hold data amount required for the autocorrelation-function calculation, the period detector 43 has inside a function to maintain a past conversion original signal S. It is desirable to perform the autocorrelation-function calculation at the time when a time of the wave period determined at a calculation of the immediately preceding autocorrelation function has passed.

The correlation calculator 41 calculates a cross-correlation function between the conversion original signal S and the low-band signal for combination LS in a similar manner to that in the third embodiment, at the time when the period information T is received from the period detector 42, described above. Although cross-correlation is calculated once every frame in the third embodiment, in a case of an audio signal for example, there may be a plurality of periods in a frame and a wave period may contain a plurality of frames. Signal adjustment is more effectively performed in conjunction with synchronization with such a wave period.

Although the fourth embodiment shows an example of an application of the period detector 43 in the third embodiment, the period detector can be applied to the first embodiment by provision of period information in the zero-crossing detectors in the first and the second embodiments.

According to the fourth embodiment, a signal is adjusted in accordance with a period of the frequency-converted original signal S and therefore there is an effect that phase adjustment can be more naturally realized, in addition to the same effect as in the third embodiment.

(E) Fifth Embodiment

A speech band extension device according to the fifth embodiment of the present invention will be described below in detail with reference to the drawings.

The speech band extension device of the fifth embodiment includes, in a similar manner to the embodiments described above, a sampling frequency converter 11, a low-band signal generator 12, a high-band signal generator 13, a soundless-section signal generator 14, and an adjustment adder 20 (see FIG. 1).

In the fifth embodiment, however, an internal configuration of the adjustment adder 20 differs from those in the embodiments described above.

Figure 9:
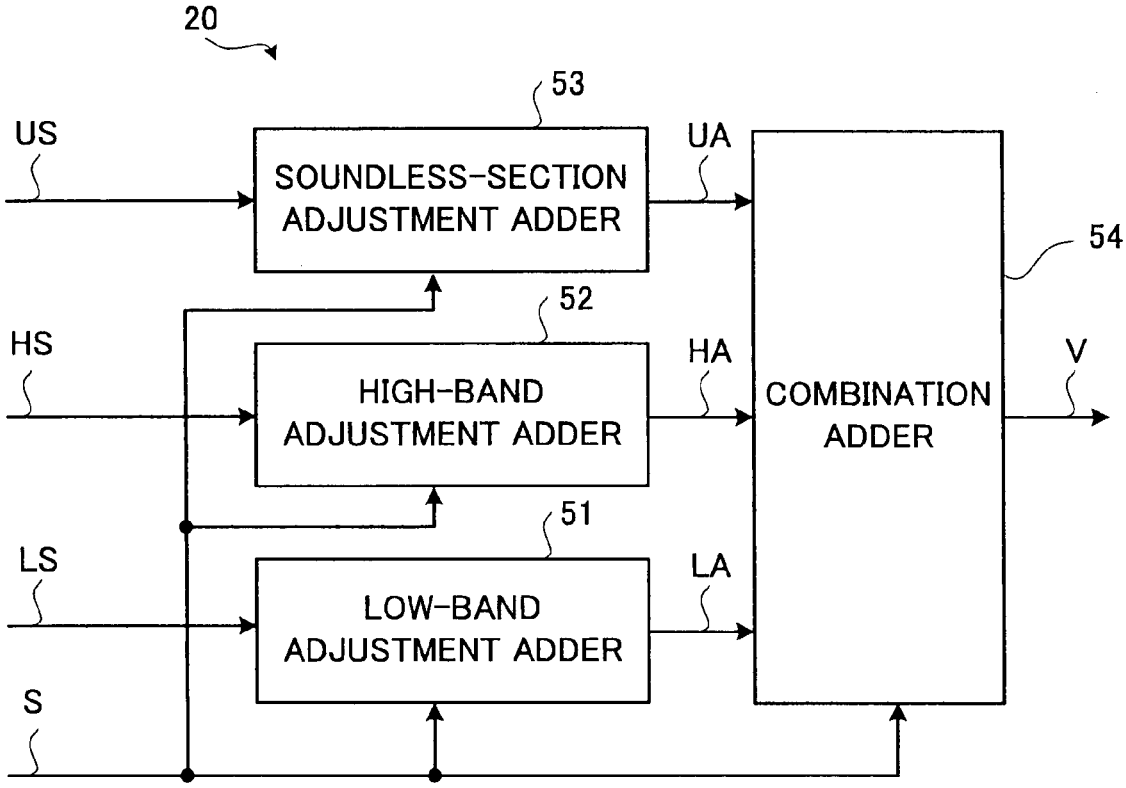
FIG. 9 is a block diagram showing a detailed configuration of an adjustment adder in the fifth embodiment.

In the fifth embodiment, as shown in FIG. 9, the adjustment adder 20 includes a low-band adjuster 51, a high-band adjuster 52, a soundless-section adjuster 53, and a combination adder 54.

The low-band adjuster 51 synchronizes timing of a low-band signal for combination LS outputted from the low-band signal generator 12 with a frequency-converted original signal S. The high-band adjuster 52 synchronizes timing of a high-band signal for combination HS outputted from the high-band signal generator 13 with the frequency-converted original signal S. The soundless-section adjuster 53 synchronizes timing of the soundless-section signal for combination US outputted from the soundless-section signal generator 14 with the frequency-converted original signal S. The combination adder 54 weights and combines output signals LA, HA and UA from the low-band adjuster 51, the high-band adjuster 52 and the soundless-section adjuster 53, with the frequency-converted original signal S.

Figure 10:
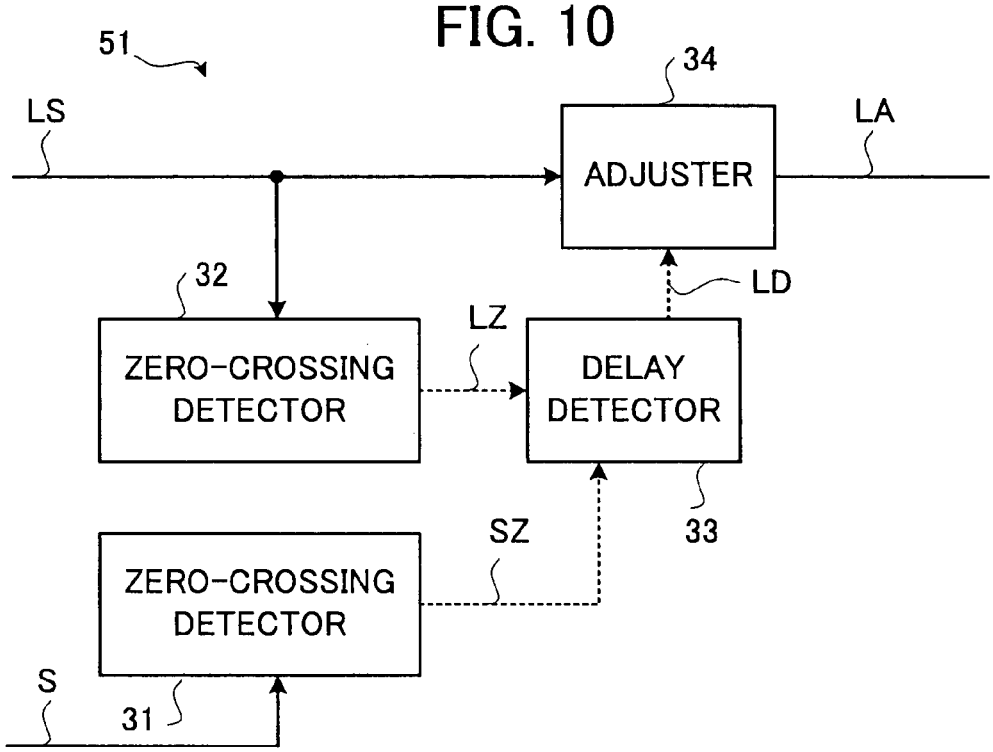
FIG. 10 is a block diagram showing a detailed configuration of a low-band adjuster in the fifth embodiment.

As the low-band adjuster 51, the high-band adjuster 52, and the soundless-section adjuster 53 have similar or substantially the same configuration, a detailed configuration of the low-band adjuster 51 is representatively shown in FIG. 10. Constituent elements in FIG. 10 that are the same as or correspond to those in FIG. 3 showing the low-band adjustment adder 21 in the first embodiment are assigned the same reference numerals or symbols.

The low-band adjuster 51 in the fifth embodiment has a configuration in which the addition circuit 35 is removed from the low-band adjustment adder 21 in the first embodiment. That is, in this configuration, the adjusted low-band signal LA which is subjected to the adjusting of the timing is outputted from the adjuster 34 directly to the combination adder 54. The zero-crossing detectors 31 and 32, the delay detector 33, and the adjuster 34 similarly operate as those in the first embodiments. Also, the zero-crossing detector 31 may be shared by the low-band adjuster 51, the high-band adjuster 52, and the soundless-section adjuster 53. Although the adjusting of the timing is performed through the use of a zero-crossing detector in this example, the adjusting of the timing may also be performed by cross-correlation calculation at a correlation calculator or a period calculator in place of the zero-crossing detector.

According to the fifth embodiment, the same effect as in the first embodiment can be realized. Moreover, the fifth embodiment has the configuration that the low-band adjuster 51, the high-band adjuster 52, and the soundless-section adjuster 53 are connected in parallel and thereby it is advantageously realized in a case that a user can select which component is subjected to the adjusting of the timing.

(F) Other Embodiment

The above-described embodiments show the cases each using three types of band-extended component signals that are the low-band component signal, the high-band component signal, and the soundless-section component signal. However, number of types of the band-extended component signals is not limited to three and may be more or less than three. For example, a plurality of types of high-band component signals which lie within different frequency bands respectively may be generated.

Further, although the above-described embodiments show the cases in which the adjusting of the timing is performed for all of the band-extended component signals relative to an original signal, the adjusting of the timing may be performed for some of the band-extended component signals relative to the original signal. Furthermore, the device may be designed in such a way that a user can select a band-extended component signal subjected to the adjusting of the timing or a user can select a mixing ratio of the band-extended component signal.

Although the above-described first, second, and fifth embodiments show the cases in which the signal timing is defined by using the zero crossing, the signal timing may be defined by using a maximum value or a minimum value of a peak in a frame in place of the zero crossing.

In the above-described embodiments, although the description has been made as to the cases in which the speech band extension devices are formed by hardware, the speech band extension device may be formed by software. Further, part of the processing may be performed at a stage of an analog signal.

What is claimed is:

1. A speech band extension device comprising:

band-extended audio generation means which generates a band-extended audio signal from an original audio signal, the band-extended audio signal including a component lying within a frequency band that is not included in a frequency band of the original audio signal;

timing shift detection means which detects a timing shift between the original audio signal and the band-extended audio signal;

adjustment means which adjusts one of timing of the band-extended audio signal and timing of both the band-extended audio signal and the original audio signal, in accordance with the detected timing shift; and combination means which combines the original audio signal and the band-extended audio signal after the adjusting of the timing;

wherein the adjustment means, which treats each audio frame of a predetermined period of time as a processing unit, generates a delayed band-extended audio signal by inserting a delay time corresponding to the detected timing shift, calculates a waveform period at a latest edge portion of the delayed band-extension audio signal, replicates a signal waveform, corresponding to a predetermined number of waveform periods from the latest edge portion of the delayed band-extended audio signal to an oldest portion of the delayed band-extended audio signal, and uses the replicated signal waveform as an interpolation signal at a position shifted toward the latest edge portion, and combines a portion of the interpolation signal, corresponding to a shortage of the signal waveform occurring in the latest edge portion of the audio frame of the delayed band-extended audio signal, with the delayed band-extended audio signal, thereby generating the band extended audio signal after the adjusting of timing.

2. The speech band extension device according to claim 1, wherein the timing shift detection means includes:

a first zero-crossing detector which obtains zero-crossing information of the original audio signal;

a second zero-crossing detector which obtains zero-crossing information of the band-extended audio signal; and a timing shift detector which detects the timing shift between the original audio signal and the band-extended audio signal in accordance with the zero-crossing information of the original audio signal and the zero-crossing information of the band-extended audio signal.

3. The speech band extension device according to claim 1, wherein the timing shift detection means includes a correlation calculator which detects the timing shift between the original audio signal and the band-extended audio signal in accordance with a cross-correlation between the original audio signal and the band-extended audio signal.

4. The speech band extension device according to claim 1, further comprising a period detector which obtains information on periodicity of the original audio signal;

wherein the timing shift detection means confines a range of corresponding timing in the band-extended audio signal in accordance with a period of the original audio signal.

5. The speech band extension device according to claim 1, wherein when 1st to N-th band-extended audio signals are provided as the band-extended audio signal, the timing shift detection means, the adjustment means, and the combination means are provided for each of the 1st to N-th band-extended audio signals, and the timing shift detection means, the adjustment means, and the combination means for the (n+1)-th band-extended audio signal, where n is 1 to N−1, process a signal outputted from the combination means for the n-th band-extended audio signal in place of the original audio signal.

6. The speech band extension device according to claim 1, wherein when 1st to N-th band-extended audio signals are provided as the band-extended audio signal, the timing shift detection means and the adjustment means are provided for each of the 1st to N-th band-extended audio signals, and the combination means is shared for the 1st to N-th band-extended audio signals.

7. A speech band extension device, comprising:

band-extended audio generation means receiving an original audio signal of a first frequency band, and generating a band-extended audio signal that includes a component at a second frequency band outside the first frequency band;

timing shift detection means detecting a timing shift between the original audio signal and the band-extended audio signal;

adjustment means adjusting timing of the band-extended audio signal in accordance with the timing shift, wherein the adjustment means processes the band-extended audio signal by frame, and if the time shift adds a negative delay to the band-extended audio signal in a frame, the adjustment means calculates a signal waveform of one waveform period at a latest edge of the delayed band-extension audio signal in the frame, replicates the signal waveform, shifts the replicated signal waveform to one waveform period after the latest edge, and combines a portion of the shifted signal waveform corresponding to the negative delay with the delayed band-extension audio signal, to thereby adjust the timing of the band-extended audio signal; and combination means combining the original audio signal and the band-extended audio signal after the adjusting of the timing.

* * * * *